US012252219B1

(12) United States Patent
Doss et al.

(10) Patent No.: US 12,252,219 B1
(45) **Date of Patent: *Mar. 18, 2025**

(54) ANCHOR SYSTEM

(71) Applicant: Hotwire Development, LLC, Scottsdale, AZ (US)

(72) Inventors: Jeffrey S. Doss, Scottsdale, AZ (US); Jason Swanson, Fountain Hills, AZ (US); Joshua Wedge, Cave Creek, AZ (US)

(73) Assignee: Hotwire Development, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/095,308

(22) Filed: Jan. 10, 2023

Related U.S. Application Data

(63) Continuation of application No. 17/028,951, filed on Sep. 22, 2020, now Pat. No. 11,548,594, which is a continuation of application No. 16/908,585, filed on Jun. 22, 2020, now Pat. No. 10,780,952.

(60) Provisional application No. 62/864,473, filed on Jun. 20, 2019.

(51) Int. Cl.
*B63B 21/24* (2006.01)
*B63B 21/50* (2006.01)

(52) U.S. Cl.
CPC ..... *B63B 21/24* (2013.01); *B63B 21/50* (2013.01)

(58) Field of Classification Search
CPC ... B63B 21/00; B63B 2021/003; B63B 21/24; B63B 21/29; B63B 21/50; E02B 3/108; E02B 3/127
See application file for complete search history.

(56) References Cited

U.S. PATENT DOCUMENTS 2,232,163 A 2/1941 Brecht
4,357,009 A 11/1982 Baker
4,396,383 A * 8/1983 Hart ..... A61J 1/2093 604/82
4,405,129 A 9/1983 Stuckey
4,527,796 A 7/1985 Critelli
(Continued)

FOREIGN PATENT DOCUMENTS

WO WO-2009023849 A1 * 2/2009 ..... A45F 3/20

OTHER PUBLICATIONS

Office Action (Notice of Allowance and Fees Due (PTOL-85)) dated Sep. 20, 2022 for U.S. Appl. No. 17/028,951 (pp. 1-7).

*Primary Examiner* — Ajay Vasudeva
(74) *Attorney, Agent, or Firm* — Booth Udall Fuller, PLC; Kenneth C. Booth

(57) ABSTRACT

An anchor system with a bridle substrate and harness configured to attach to an anchor line. An outer bladder surrounds an inner bladder for coupling on top of the bridle substrate. Water enters the anchor system through a water inlet that feeds directly to the inner bladder and fills that first. Water then overflows from the inner bladder to the outer bladder to fill that second. The inner bladder provides stability and is positioned with a majority of its volume closer to an uphill end of the anchor bladder while the outer bladder is positioned with a majority of its volume closer to a downhill end of the anchor bladder. Reinforcement connectors for each bladder resist deformation of the bladders to resist movement of the anchor bladder while filling.

20 Claims, 9 Drawing Sheets

(56) References Cited

U.S. PATENT DOCUMENTS

| | | | | | |
|---|---|---|---|---|---|
| 4,529,102 | A | * | 7/1985 | Quinn | A61J 1/12 222/456 |
| 4,743,236 | A | * | 5/1988 | Manschot | A61F 5/4405 600/580 |
| 4,863,452 | A | * | 9/1989 | Irmiter | A61M 1/3627 604/122 |
| 5,085,349 | A | * | 2/1992 | Fawcett | A47G 19/2266 224/148.2 |
| 5,509,898 | A | * | 4/1996 | Isono | A61J 1/2093 604/416 |
| 5,787,835 | A | | 8/1998 | Remnant | |
| 5,816,982 | A | | 10/1998 | Croushore | |
| 6,164,870 | A | * | 12/2000 | Baruh | E02B 3/108 405/91 |
| 7,181,795 | B2 | | 2/2007 | Wu | |
| 7,491,016 | B2 | * | 2/2009 | Baruh | E02B 3/108 405/116 |
| 8,887,962 | B2 | * | 11/2014 | Herivel | A45F 3/20 383/68 |
| 9,062,469 | B2 | | 6/2015 | Auston | |
| 9,210,990 | B2 | * | 12/2015 | Hoskins | A45F 3/20 |
| 10,780,952 | B1 | * | 9/2020 | Doss | B63B 21/50 |
| 11,548,594 | B2 | * | 1/2023 | Doss | B63B 21/50 |
| 2002/0026890 | A1 | | 3/2002 | Zook | |
| 2013/0343675 | A1 | | 12/2013 | Gourchounian | |
| 2015/0232153 | A1 | | 8/2015 | Beech | |

* cited by examiner

ANCHOR SYSTEM

CROSS REFERENCE TO RELATED APPLICATIONS

This application is a continuation of earlier U.S. Utility patent application Ser. No. 17/028,951 entitled "Bladder Anchor System" to Jeffrey S. Doss, et al. that was filed on Sep. 22, 2020, which application is a continuation of earlier U.S. Utility patent application Ser. No. 16/908,585 entitled "Bladder Anchor System" to Jeffrey S. Doss, et al. that was filed on Jun. 22, 2020, which application claims the benefit of the filing date of U.S. Provisional Patent Application No. 62/864,473 entitled "BLADDER ANCHOR SYSTEM" to Jeffrey S. Doss, et al. that was filed on Jun. 20, 2019, the disclosures of which are hereby incorporated herein by this reference.

TECHNICAL FIELD

Aspects of this document relate generally to anchor systems for boats, and more specifically to bladder anchors used to secure a boat to a shore without drilling or inserting anchors into the shore.

BACKGROUND

Boat anchors are common devices used to connect a vessel to the bed or shoreline of a body of water to prevent the craft from drifting due to wind, waves or current. Various types of anchors may be utilized to secure a vessel. For example, a heavy metallic anchor secured to a boat by a rope, such as a strong marine rope, anchor line, harness line or chain, may be positioned on the bed of a body of water. Such heavy anchors derive a significant portion of their holding power from their mass, while also often employing physical features, such as flukes or claws, which may hook or embed a distance into a pliable seabed to further secure the vessel. Other types of anchoring systems may utilize mooring of watercraft to permanent structures that are located on or near shorelines and many include quays, wharfs, jetties, piers, anchor buoys, mooring buoys and the like. Boats may be secured to a permanent mooring structure to anchor the crafts and forestall free movement of the vessels on the water. Still other anchoring systems may allow watercraft to be secured directly to a shoreline. For instance, when a vessel is near a sand or dirt shoreline, stakes may be driven into the ground on the shoreline and attached anchor lines may secure the boat preventing its movement upon the water. When a shoreline is formed of a rocky or hard material, stakes may be secured within holes driven or drilled into the rocky shoreline and a watercraft may be anchored by harness lines attached to the secured stakes.

The type of anchor a watercraft employs is often influenced by the body of water in which the vessel operates. For example, a boat operating in a reservoir or lake bordered by steep canyon walls may not successfully utilize a heavy anchor, because the abrupt pitch of the canyon wall shoreline and the corresponding depth of the lake bottom may render such a heavy anchor unsuccessful, or, at the very least, impractical because of the inability for the anchor to feasibly rest upon the bottom of the lake. Such heavy anchors might remain aweigh and simply hang on their anchor lines without effectively contacting anything solid. Lake Powell and Lake Mead, which are reservoirs along the Colorado River, are both examples of water bodies that are substantially surrounded by rocky structures. Hence, one effective method of anchoring boats in those lakes involves securing boats to stakes driven or drilled into the rocky shorelines. However, while such anchoring is effective, it can be detrimental to the shoreline, because, over time, as watercraft are anchored at various locations around the lakes, the shorelines become riddled with holes from previous anchor stakes, which holes leave the shorelines damaged and unattractive. To prevent further damage to the shorelines, laws have been enacted making it illegal to drive or drill stakes into the rocky shorelines of Lake Mead and Lake Powell. Hence, a need exists for an anchoring system that effectively secures a watercraft to a rocky shoreline without damaging the shoreline.

SUMMARY

Aspects of this document relate to an anchor system may comprise an uphill end and a downhill end, a bridle comprising a bridle substrate, a bridle harness extending across and coupled to the bridle substrate, the bridle harness comprising attachment points configured to couple to anchor lines, an outer bladder configured to be placed upon the bridle, the outer bladder comprising an outer bladder shell with a bottom wall and a top wall defining an outer bladder volume therein, a first plurality of outer bladder reinforcement connector points on the bottom wall and a second plurality of outer bladder reinforcement connector points on the top wall, a plurality of outer bladder reinforcement connectors extending between the first plurality of outer bladder reinforcement connector points and the second plurality of outer bladder reinforcement connector points, the outer bladder comprising an outer bladder drain tube extending from and in fluid communication with the outer bladder volume at the downhill end of the anchor system, an inner bladder comprising an inner bladder shell with at least a top wall defining an inner bladder volume therein, and a plurality of inner bladder reinforcement connectors coupled to the top wall of the inner bladder and extending from the top wall of the inner bladder toward the bottom wall of the outer bladder, the inner bladder positioned within the outer bladder and further comprising at least one outer bladder reinforcement connector port extending through the inner bladder and surrounding at least one outer bladder reinforcement connector of the plurality of outer bladder reinforcement connectors such that the outer bladder reinforcement connector passes through the inner bladder but does not contact the inner bladder volume, and a plurality of water exit ports extending through the top wall of the inner bladder adjacent the uphill end of the anchor system, the water exit ports providing fluid communication between the inner bladder volume and the outer bladder volume, the inner bladder further comprising an inner bladder drain tube extending from and in fluid communication with the inner bladder volume at the downhill end of the anchor system, the inner bladder drain tube aligned with and extending into the outer bladder drain tube such that water draining from the inner bladder drain tube exits the anchor system through the outer bladder drain tube, a water inlet coupling mounted on an outer surface of the outer bladder, the water inlet coupling configured to couple to a water pump and comprising a water inlet mounted to both the outer bladder shell and the inner bladder shell and extending through the outer bladder volume to the inner bladder volume such that water introduced at a water inlet coupling of the water inlet contacts the inner bladder volume before it passes through the inner bladder volume to contact the outer bladder volume, the water inlet comprising a collapsible water inlet neck extending between the outer bladder shell and the inner bladder shell, a drain tube clamp configured to clamp both the inner bladder drain tube and the outer bladder drain tube simultaneously, the drain tube clamp positioned on the anchor system adjacent the uphill end on the top wall of the outer bladder, at least one air vent extending through the outer bladder shell and comprising a removable vent cap coupled thereto, the at least one air vent configured to regulate air into and out of the outer bladder volume, and at least one additional drain extending through the outer bladder adjacent an edge of the outer bladder and comprising at least one removable drain cap coupled thereto, wherein the bridle harness further comprising a plurality of bridle harness corner straps coupled to the bridle harness, each bridle harness corner strap extending over a corner of the outer bladder.

Particular embodiments may comprise one or more of the following features. The bridle attachment points may be bridle harness loops. The inner bladder may be positionally fixedly coupled to the outer bladder, and a majority of the inner bladder volume is closer to the uphill end of the anchor system than to the downhill end and a majority of the outer bladder is closer to the downhill end of the anchor system than to the uphill end. A vertical gap between the inner bladder top wall and the outer bladder top wall when the outer bladder is filled. The plurality of outer bladder reinforcement connectors from one outer bladder reinforcement connector points of the first plurality of outer bladder reinforcement connector points may extend to multiple outer bladder reinforcement connectors of the second plurality of outer bladder reinforcement connector points. The bladder anchor system may comprise the bladder anchor and bladders incorporated into a boat.

According to an aspect of the disclosure, an anchor system may comprise a bridle comprising a bridle harness with attachment points each configured to couple to an anchor line, an outer bladder coupled to the bridle harness, the outer bladder comprising an outer bladder shell defining an outer bladder volume therein, the outer bladder comprising an outer bladder drain in fluid communication with the outer bladder volume adjacent a first end of the anchor system, opposite a second end of the anchor system, an inner bladder positioned within the outer bladder and comprising an inner bladder shell defining an inner bladder volume therein, the inner bladder comprising at least one water exit port closer to the first end of the anchor system than to the second end, the at least one water exit port providing fluid communication between the inner bladder volume and the outer bladder volume, the inner bladder comprising an inner bladder drain in fluid communication with the inner bladder volume adjacent the first end of the anchor system, and a water inlet configured to receive water from outside the outer bladder directly into the inner bladder volume such that water introduced through the water inlet contacts the inner bladder volume before it passes through the inner bladder volume to contact the outer bladder volume.

Particular embodiments may comprise one or more of the following features. The outer bladder drain may be an outer bladder drain tube extending from the outer bladder volume, wherein the inner bladder drain is an inner bladder drain tube extending from the inner bladder volume, and wherein the inner bladder drain tube is co-extensive with at least a portion of the outer bladder drain tube such that water draining from the inner bladder drain tube passes through a portion of the outer bladder drain tube. A drain tube clamp configured to clamp the outer bladder drain tube. The drain tube clamp may be configured to clamp both the outer bladder drain tube and the inner bladder drain tube simultaneously. The drain tube clamp may be positioned on the anchor system adjacent the uphill end on the top wall of the outer bladder. The bridle, outer bladder, inner bladder and water inlet each comprise a first bridle, first outer bladder, first inner bladder and first water inlet forming a first anchor, the anchor system further comprising at least a second bridle, a second outer bladder, a second inner bladder and a second water inlet all operatively coupled together like the first bridle, first outer bladder, first inner bladder and first water inlet forming a second anchor, wherein the anchor system further comprising at least one anchor line coupled to each of the first anchor and the second anchor, the first anchor and the second anchor configured to couple to a boat to anchor the boat to the shore through the first anchor and the second anchor. A first plurality of outer bladder reinforcement connector points on a bottom wall of the outer bladder and a second plurality of outer bladder reinforcement connector points on a top wall of the outer bladder, a plurality of outer bladder reinforcement connectors extending between the first plurality of outer bladder reinforcement connector points and the second plurality of outer bladder reinforcement connector points. A plurality of inner bladder reinforcement connectors coupled to a top wall of the inner bladder and extending from the top wall of the inner bladder toward the bottom wall of the outer bladder. A majority of the inner bladder volume may be positioned closer to the first end of the anchor system than to the second end of the anchor system. The anchor system may further comprise a boat with a pump mounted to the boat, wherein the pump is configured to pump water from a body of water in which the boat is floating into the water inlet.

According to an aspect of the disclosure, an anchor system may comprise a bridle comprising a bridle harness with attachment points each configured to couple to an anchor line, an outer bladder coupled to the bridle harness, the outer bladder comprising an outer bladder shell defining an outer bladder volume therein, the outer bladder comprising an outer bladder drain in fluid communication with the outer bladder volume adjacent a downhill end of the anchor system, opposite an uphill end of the anchor system, an inner bladder fixedly coupled to the outer bladder shell between the outer bladder shell and the bridle and comprising an inner bladder shell defining an inner bladder volume therein, the inner bladder comprising an inner bladder drain in fluid communication with the inner bladder volume adjacent the downhill end of the anchor system, a water inlet configured to receive water from outside the outer bladder directly into the inner bladder volume, wherein a majority of the inner bladder volume is closer to the uphill end of the anchor system than to the downhill end, and a majority of the outer bladder volume is closer to the downhill end of the anchor system than to the uphill end.

Particular embodiments may comprise one or more of the following features. The outer bladder drain may be an outer bladder drain tube extending from the outer bladder volume, wherein the inner bladder drain is an inner bladder drain tube extending from the inner bladder volume, and wherein the inner bladder drain tube is co-extensive with at least a portion of the outer bladder drain tube such that water draining from the inner bladder drain tube passes through a portion of the outer bladder drain tube. The inner bladder may further comprise at least one water exit port providing fluid communication between the inner bladder volume and the outer bladder volume, the anchor system further comprising a water inlet configured to receive water from outside the outer bladder directly into the inner bladder volume such that water introduced through the water inlet contacts the inner bladder volume before it passes through the inner bladder volume to contact the outer bladder volume. A first plurality of outer bladder reinforcement connector points on a bottom wall and a second plurality of outer bladder reinforcement connector points on a top wall, a plurality of outer bladder reinforcement connectors extending between the first plurality of outer bladder reinforcement connector points and the second plurality of outer bladder reinforcement connector points. The inner bladder may be positioned within the outer bladder, the anchor system further comprising at least one outer bladder reinforcement connector port extending through the inner bladder and surrounding at least one outer bladder reinforcement connector of the plurality of outer bladder reinforcement connectors such that the outer bladder reinforcement connector passes through the inner bladder but does not contact the inner bladder volume. At least one air vent may extend through the outer bladder shell and comprising a removable vent cap coupled thereto, the at least one air vent configured to permit air to enter the outer bladder volume when water drains from the anchor system. The anchor system may further comprise a boat with a pump mounted to the boat, wherein the pump is configured to pump water from a body of water in which the boat is floating into the water inlet.

According to an aspect of the disclosure, an anchor system may comprise a bridle comprising a bridle harness with attachment points each configured to couple to an anchor line, a bladder coupled to the bridle harness, the bladder comprising at least two compartments configured to receive water therein, and a water inlet configured to receive water from outside the bladder directly into a first of the at least two compartments, wherein the first of the at least two compartments is in fluid communication with a second of the at least two compartments and configured so that water from the first of the at least two compartments overflows into a second of the at least two compartments in response to the water being fed into the first of the at least two compartments through the water inlet.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that he can be his own lexicographer if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
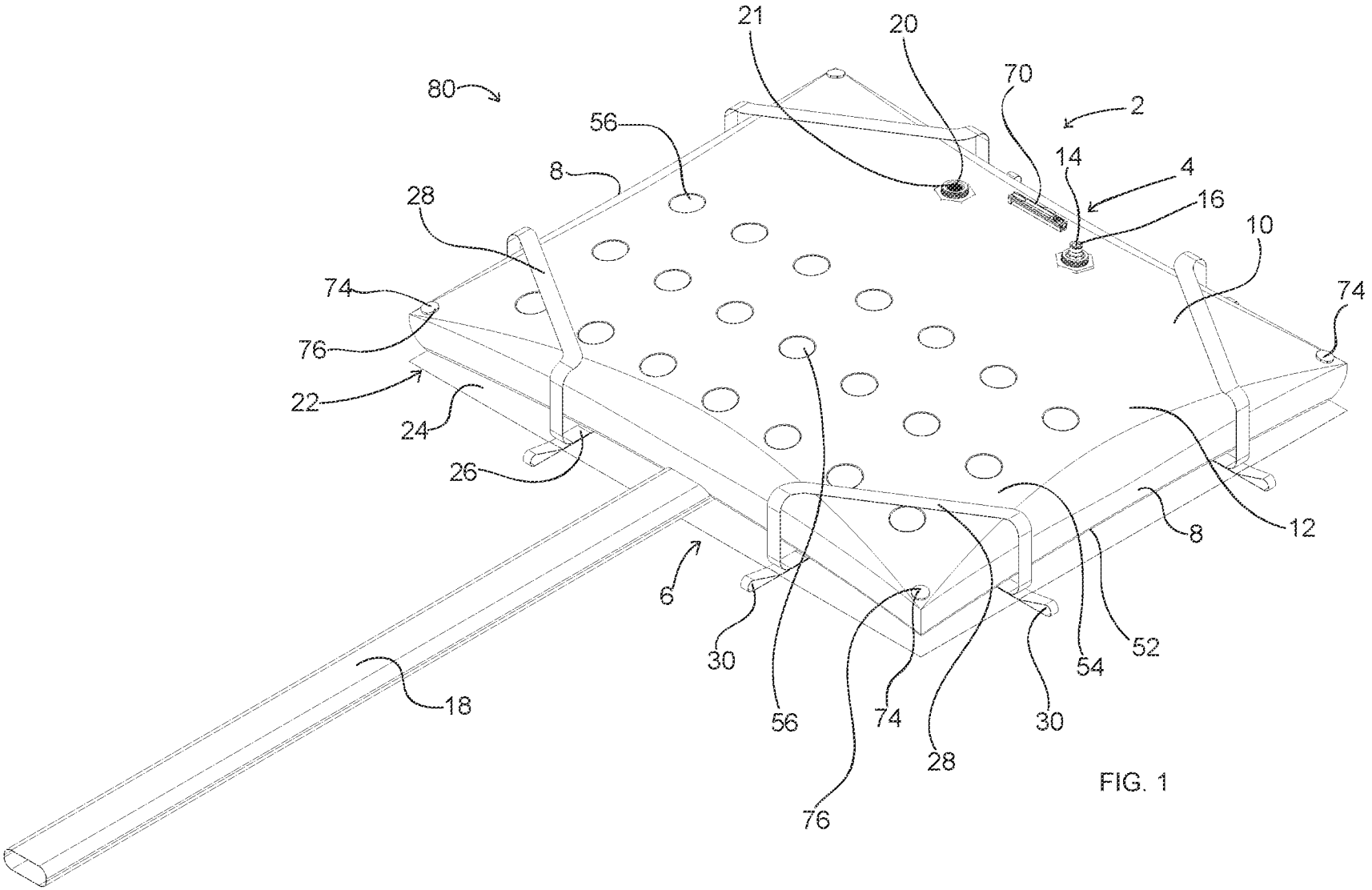
FIG. 1 is a perspective view of a bladder anchor with the drain tubes extended.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure relates to an anchoring system that incorporates a bridle configured to lie on a shoreline and having attached harness loops, wherein a bladder may be configured to be positioned on the bridle and filled with lake water to heavily weigh down the bridal upon the shoreline, and, thereby, secure a watercraft anchored to the bridle attachment points of the weighed-down bridle. Although the anchoring system may be useful on a rocky shoreline to establish an anchor without permanently damaging the shoreline where previously such an anchor was not possible, the anchoring systems discussed throughout this disclosure are relevant and useful for any shoreline including, without limitation, rocky, sandy or grassy shorelines, and even docks. A variety of different implementations of the present disclosure are discussed below. These implementations introduce improvements to conventional anchoring systems. It should be understood that the components depicted and discussed are non-limiting examples, and that the contemplated components may be combined with any of the other components in other implementations.

FIG. 1 illustrates a bladder anchor 2 formed as part of a bladder anchor system 80 the bladder anchor 2 comprising an uphill end 4, a downhill end 6 and sides 8 connecting the uphill end 4 to the downhill end 6. The bladder anchor 2 includes an outer bladder 10 with an outer bladder shell 12, a water inlet 14 with a water inlet coupling 16, receives water into the anchor system 2. An outer bladder drain 18 in the form of a tube extends from the downhill end 6 of the bladder anchor 2. An air vent 20 with an air vent cap 21 regulates air into and out of the outer bladder 10 during filling and draining of the anchor system 2. A bridle 22 sits beneath the outer bladder 10 and includes a bridle substrate 24 and a bridle harness 26. Corner harness straps 28 on the bridle harness 26 help to hold the outer bladder 10 in place over the bridle 22. The bridle 22 may be formed as one or more bridles 22.

The bridle 22 may be formed a sheet of flexible material such as a woven textile canvas or polymeric tarpaulin. The material comprising a bridle 22 may be durable and able to conform to odd, uneven and potentially jagged and pointy shapes that may be existent on a shoreline, when the bridle 22 is laid upon the shoreline. In particular implementations, bridle 22 embodiments may additionally include strengthening implements, such as a sewn-in bridle harness 26 in the form of canvas straps, or other implements, that may bolster the strength and durability of the bridle 22. Moreover, the bridle 22 may include or otherwise operate with bridle attachment points 30. In some embodiments, the attachment points 30 may be bridle harness material formed as loops and sewn back on itself. The attachment points 30 may be securely affixed to the bridle 22, so that significant force may be exerted on the attachment points 30 without the attachment points 30 tearing from or otherwise disengaging from the bridle 22. The attachment points 30 may be configured to attach to anchor lines that may be connected to a boat. Although a bridle substrate 24 is shown in examples in this disclosure, a particular substrate 24 is not required and the bridle 22 may include merely a mesh or even a single strap of a bridle harness coupled to a bladder, or the bridle may be incorporated into the bladder by coupling directly and/or permanently to the bladder.

Figure 2:
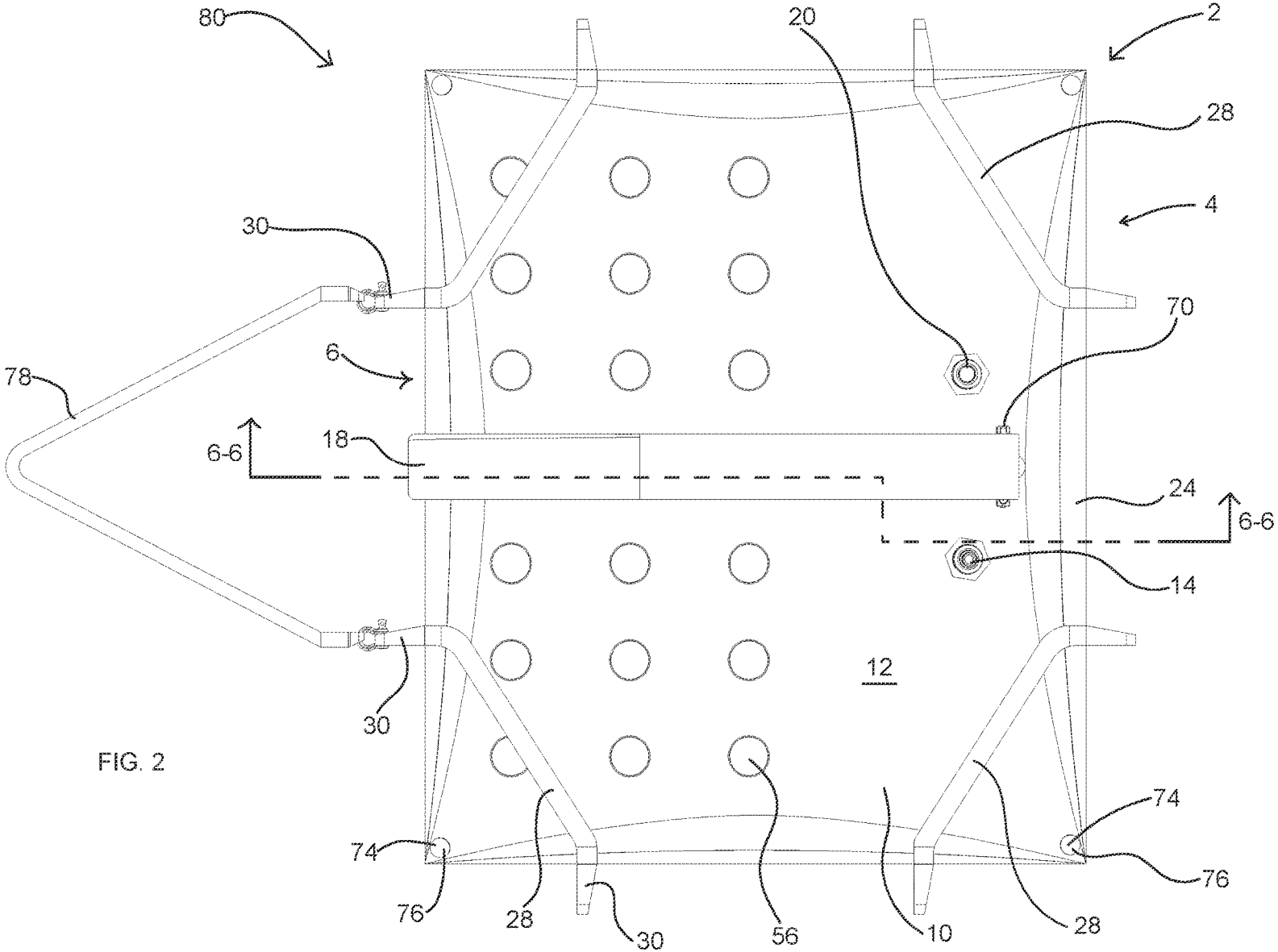
FIG. 2 is a top view of the bladder anchor of FIG. 1 with the drain tubes clamped.
Figure 7:
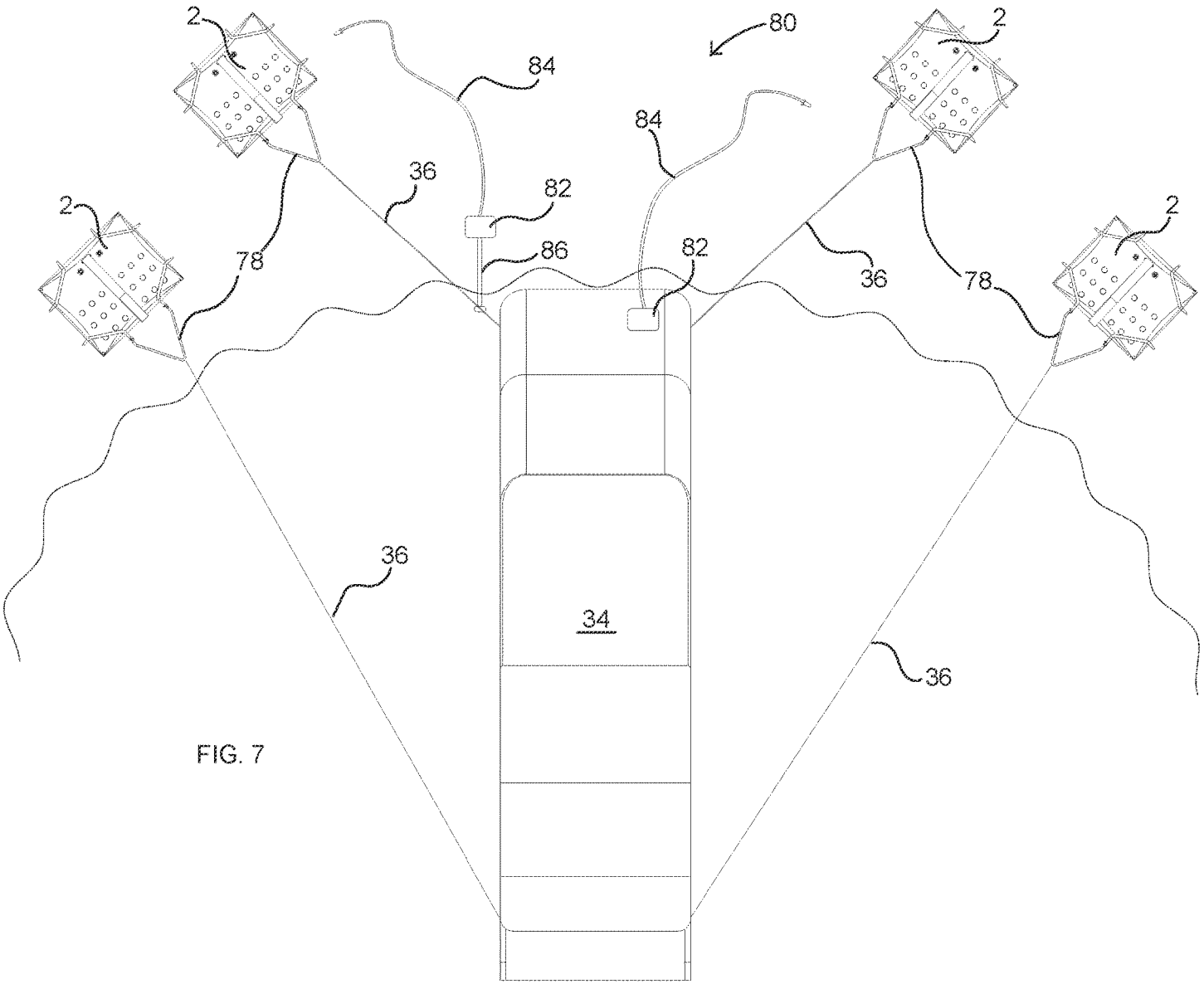
FIG. 7 is a top view of a plurality of bladder anchors like that of FIG. 2 connected to a boat.

When a bridle 22 that is separate from the bladder is implemented for use in anchoring, it may be preferable to place the bridle 22 on a relatively flat or only slightly sloped shoreline surface. In addition, it may be effective to orient the bridle 22 so that the attachment points 30 are pointing toward the body of water where the boat is desired to be anchored, particularly toward the rear anchor lines of the boat. As illustrated in FIGS. 2 and 7, each of the boat's rear anchor lines may be attached to harness attachment points 30 through anchor lines 36. The anchor lines 36 may be attached to an intermediate connector strap 78 that connects to the bridle 22 in a "V" pattern. Such a "V" pattern may help to equalize pull force on the bridle 22. A plurality of bridles 22 may be attached to the anchor lines 36 of a boat 34 in this manner. When the bridles 22 are initially laid on the shoreline and the boat anchor lines 36 are attached to the bridle 22 using connector straps 78 through the attachment points 30 of the bridles 22, it may be effective to attach the boat anchor lines 36 in a manner wherein there is initially no tension on any of the lines.

Figure 3A:
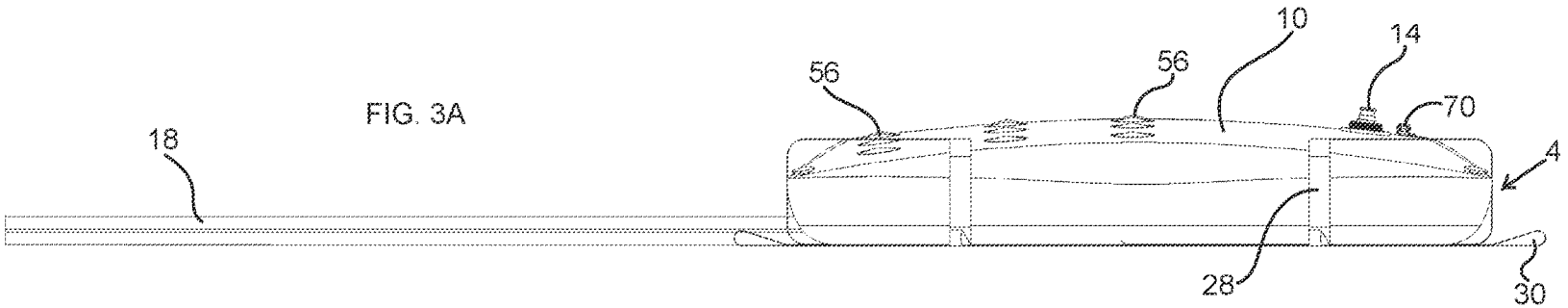
FIG. 3A is a side view of the bladder anchor of FIG. 1.
Figure 3B:
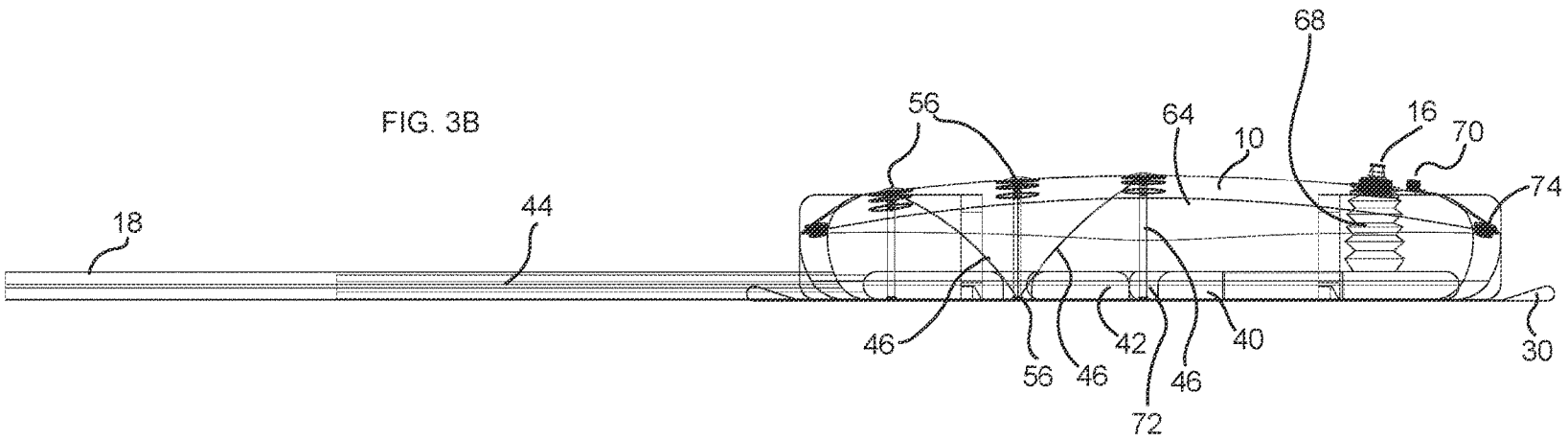
FIG. 3B is a transparent view of the bladder anchor of FIG. 1 taken from the right side of the bladder anchor.
Figure 3C:
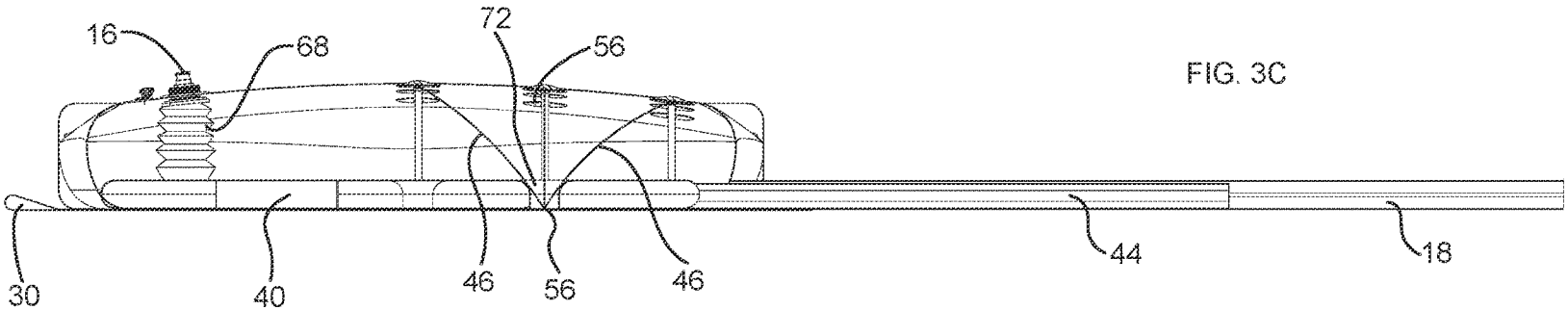
FIG. 3C is a transparent view of the bladder anchor of FIG. 1 taken from the left side of the bladder anchor.
Figure 4:
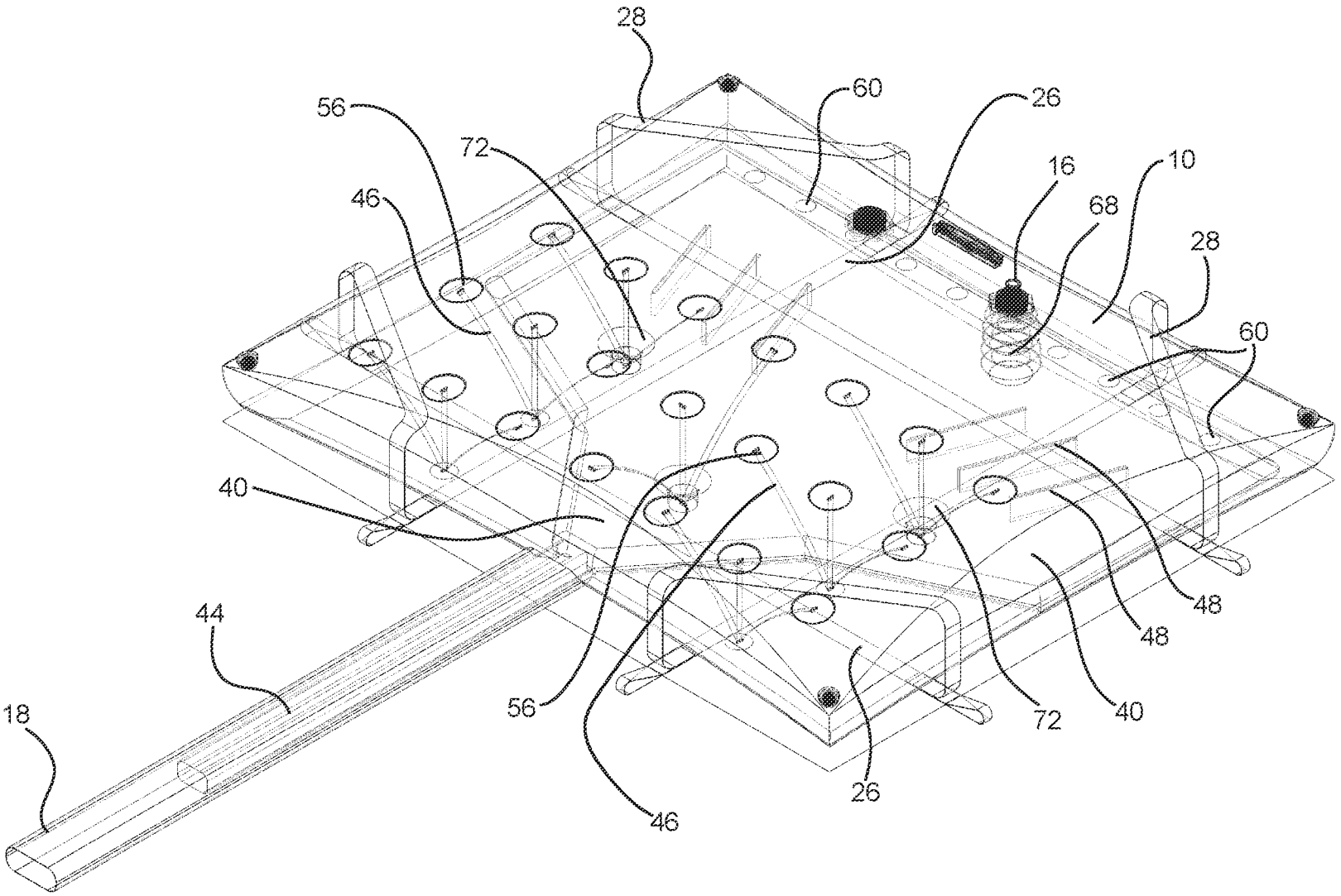
FIG. 4 is a transparent view of the bladder anchor of FIG. 1.
Figure 5:
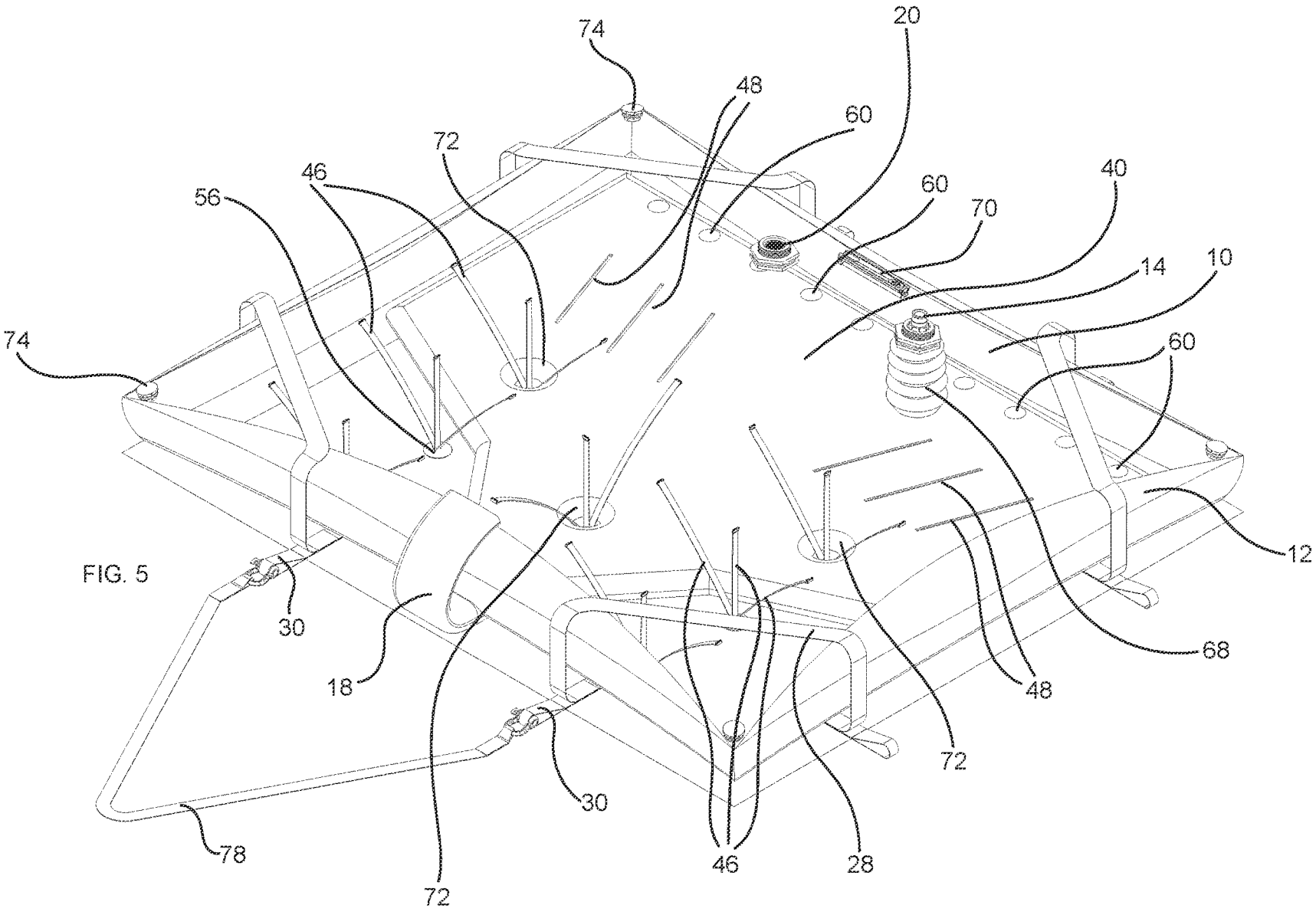
FIG. 5 is a perspective view of the bladder anchor of FIG. 2 with the top surface of the outer bladder and the drain tubes removed.

FIGS. 3A-3C illustrate side and right and left transparent views of the anchor system to show the internal components. In combination with the transparent view of FIG. 4 and the top-layer-removed view of FIG. 5, the internals of the anchor system 2 can be seen. As best seen in FIGS. 4 and 5, in a particular embodiment, an inner bladder 40 is formed within the outer bladder 10. The use of the terms "inner" and "outer" in this application is not intended to require that the "inner" parts be inside the "outer" parts, but is used instead for convenience in referencing the various similarly configured components. As explained in more detail below, other arrangements of the "inner" and "outer" components is contemplated. Outer may be considered, in all uses of the term herein, to mean "first" and "inner" to mean "second" and should be interpreted as such unless specific other limitations are associated with the use of the terms to limit them to a particular configuration or arrangement of parts.

The inner bladder 40, defined by an inner bladder shell 41, is included with a majority of its inner bladder volume 42 toward the uphill end 4 of the bladder anchor 2. The outer bladder 10 also includes an outer bladder volume 64 which includes all of the volume within the outer bladder 10 excluding that volume occupied by the inner bladder 40. When the outer bladder is filled, a vertical gap 66 exists between the inner bladder top wall 50 and the outer bladder top wall 54. As shown in FIG. 5, the inner bladder 40 narrows toward the downhill end 6 of the bladder anchor 2 until it eventually ends in the internal bladder drain tube 44. The inner bladder drain tube 44 is aligned with and extends into the outer bladder drain tube 18. In particular embodiments, the inner bladder drain tube 44 is aligned with and extends into a portion of the length of the outer bladder drain tube 18 and drains through the outer bladder drain tube 18.

The outer and inner bladders 10, 40 may comprise bags, sleeves, or other flexible containers that are configured to readily receive an infusion of water and durably store the water. Embodiments of a bladder may be formed of durable watertight material such as rubber, vinyl or other like materials. The bladder material may be flexible and may even be somewhat expandable. In addition, bladder embodiments may be formed of material that is durable and at least somewhat resistant to punctures, splits and tears. Bladder embodiments may be formed of multiple pieces stitched, seemed, welded or otherwise connected together in a watertight fashion, and/or bladder embodiments may be formed of a single integral component.

In the particular embodiment shown in FIGS. 3-6, reinforcement connectors 46, 48 are used, respectively, within the outer bladder 10 and inner bladder 40. The inner bladder 40 includes inner bladder reinforcement connectors 48 attached to the inner bladder top wall 50 and extending toward and coupled to the bottom of the inner bladder 10. The inner bladder 10 may comprise an entire separate enclosure from the outer bladder 10 that is placed within the outer bladder 10, or may use the outer bladder bottom wall 52 as the bottom wall of the inner bladder 40. Whether an additional bottom wall of the inner bladder 10 is used or only a single bottom wall 52 is used is equivalent and will depend upon the manufacturing techniques used for a particular implementation.

The reinforcement connectors 46 of the outer bladder 10 extend from the outer bladder bottom wall 52 to the outer bladder top wall 54. In particular embodiments, one or more outer bladder reinforcement connector ports 72 may be formed through the inner bladder 40 to allow the outer bladder reinforcement connectors 46 to extend from the outer bladder bottom wall 52 to the outer bladder top wall 54 in places where the inner bladder 40 would normally overlap the outer bladder bottom wall 52, without the outer bladder reinforcement connectors 46 penetrating the inner bladder 40 or coming in contact with the inner bladder volume 42. The outer bladder reinforcement connector ports 72 define a void in the inner bladder volume 42 so the inner bladder volume 42 is fully contained around the outer bladder reinforcement connector ports.

Figure 8:
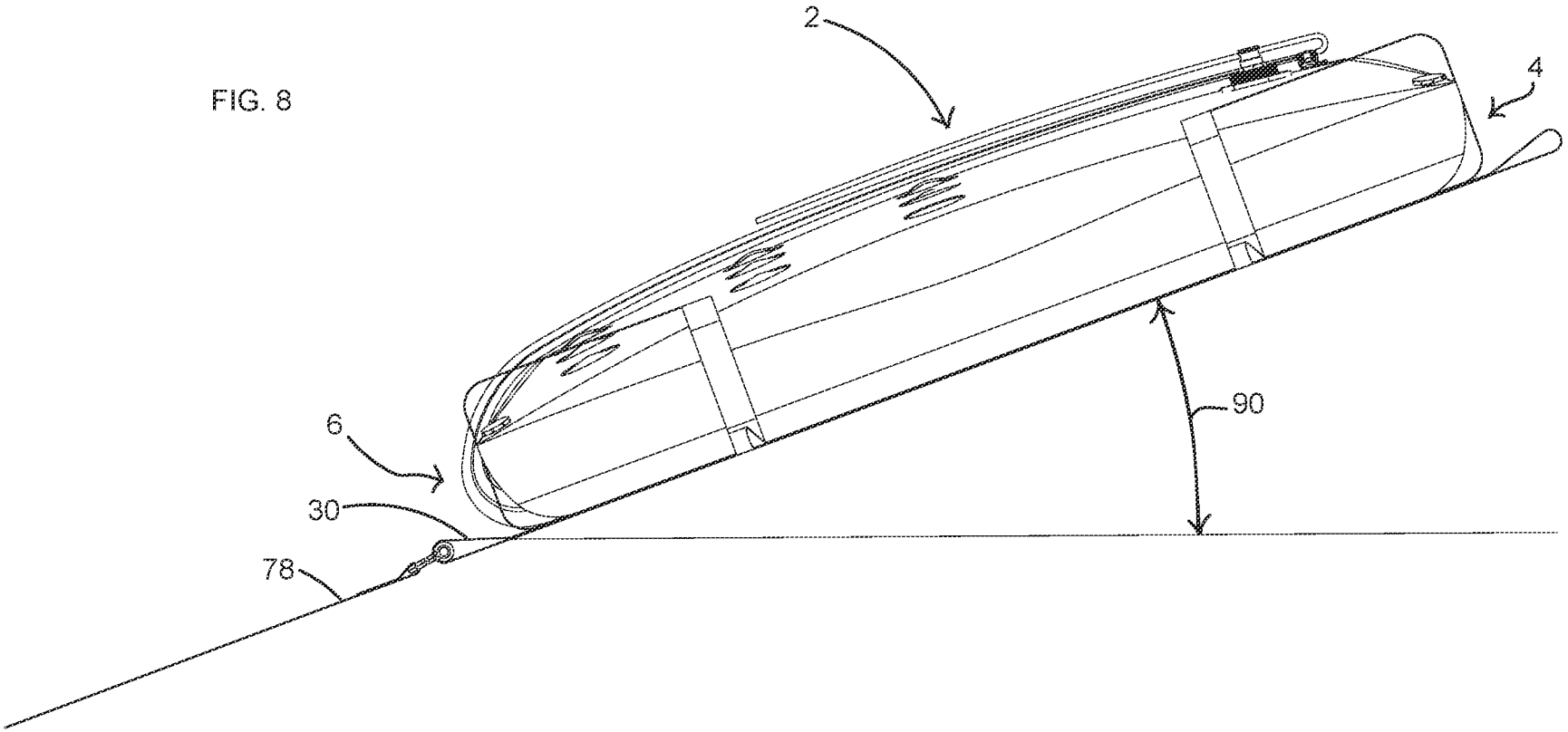
FIG. 8 is a side view of the bladder anchor of FIG. 2 shown on an incline.

When the outer bladder 10 is filled, the outer bladder reinforcement connectors 56 help to define the extent to which the outer bladder top wall 54 can extend, limiting the loft of the outer bladder 10. Without reinforcement connectors 46, it was found, particularly when the anchor system is placed on a sloped surface having an angle 90 of up to 20 degrees (see FIG. 8), that the outer bladder 10 tended to shift the water downhill, which would lift the uphill end 4 of the anchor system and drag or roll it toward the downhill end 6, making the effort of keeping the outer bladder 10 in place while it filled very difficult. By adding in the outer bladder reinforcement connectors 46, the extent to which the downhill end can extend is limited, keeping the water in the outer bladder 10 more distributed. The outer bladder reinforcement connectors 46 may be coupled directly to the outer bladder bottom wall 52 and top wall 54, or further reinforced with additional stitching, layers of material or other reinforcement to avoid tearing at outer bladder reinforcement connector points 56, which may be reinforced with connector pads surrounding each connector point 56.

Figure 6:
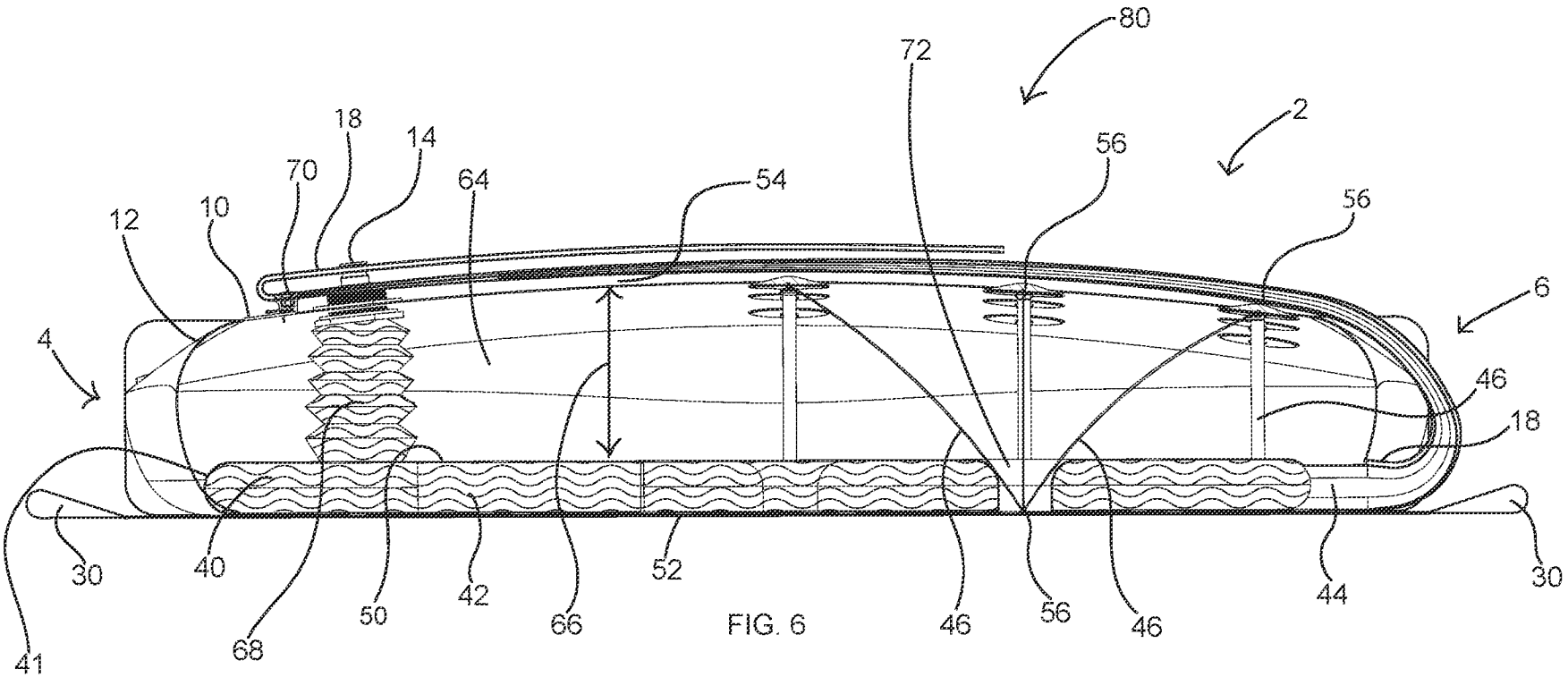
FIG. 6 is a cross-sectional view of the bladder anchor of FIG. 2 taken along section lines 6-6 showing the inner bladder filled with water.

The inner bladder 40 includes inner bladder reinforcement connectors 48 as well. In the embodiment illustrated in FIGS. 4-6, the inner bladder reinforcement connectors 48 connect the bottom wall 52 to the inner bladder top wall 50 and, similar to the outer bladder reinforcement connectors 46, restrict the loft of the inner bladder top wall 50 away from the bottom wall 52. Similarly, it was discovered that, particularly when the anchor system 2 was placed on sloped surfaces of up to 25 degrees (see FIG. 8), water within the internal bladder 40 would move to the downhill end 6 of the anchor system 2 and cause the inner bladder 40 to shift undesirably. FIG. 6 illustrates a separation between the top wall 50 of the inner bladder 40 and the top wall 54 of the outer bladder 10 when the anchor bladders 10, 40 are fully extended. In FIG. 6, the water inlet 14 and the inner bladder 40 and its internal volume 42 are illustrated with wavy lines.

As illustrated in FIGS. 4-6, at least one water exit port 60 is included on the inner bladder 40, between the inner bladder 40 and the outer bladder 10. The water exit ports 60 are included adjacent the uphill end 4 of the anchor system 2 so that water does not escape the exit ports 60 until the inner bladder 40 is almost filled. The water inlet 14 extends from outside the outer bladder 10 directly to the inner bladder volume 42 through a water inlet neck 68. In particular embodiments, the water inlet neck 68 is collapsible, and may be formed of collapsible, water-tight materials such as those that form the inner and outer bladders, or other suitable materials. The collapsibility of the water inlet neck 68 and the outer bladder 10 and inner bladder 40 permits for more condensed storage and for the bladder anchor system to be folded up when not in use.

Figure 9B:
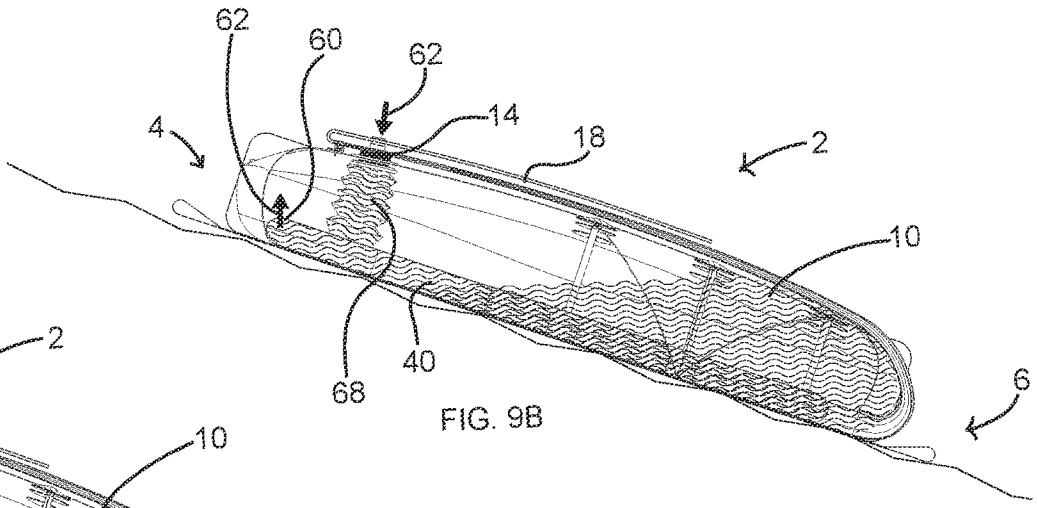
FIGS. 9A-9C are cross-sectional views of FIG. 2 like that of FIG. 6 illustrating the fill process.
Figure 9A:
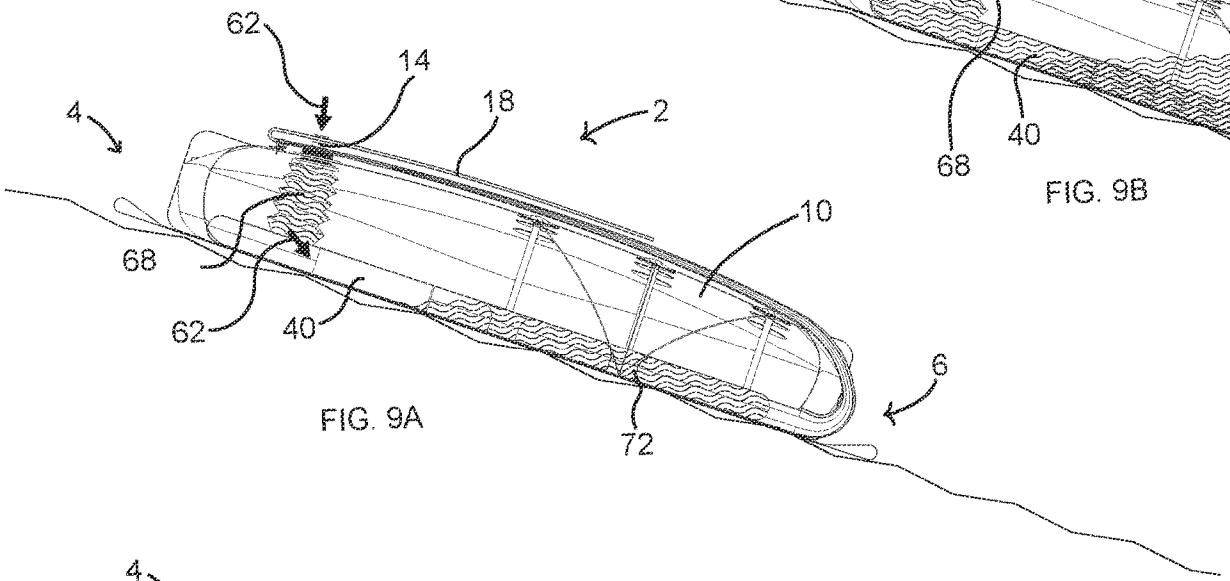
Figure 9C:
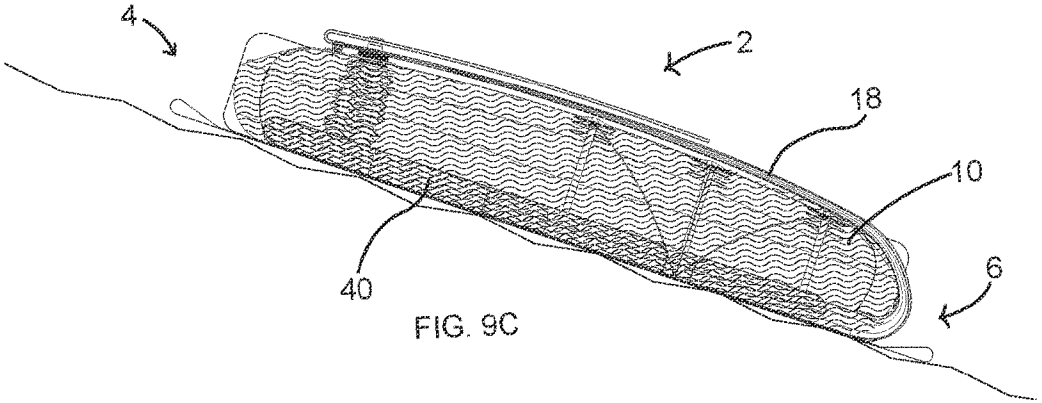

When water is added to the water inlet 14, water first fills the inner bladder 40. FIGS. 9A-9C illustrates a process of filling the bladders 10, 40 of an anchor system 2. FIG. 9A illustrates water entering the water inlet 14 and beginning to fill the inner bladder 40. The water directional arrows 62 illustrate the flow of water into the water inlet 14 and into the inner bladder 40. FIG. 9B illustrates the flow of water once the inner bladder 40 is filled, with the water escaping through the water exit ports 60 of the inner bladder 40 and starting to fill the outer bladder 10. FIG. 9C illustrates the filled state of the inner and outer bladders 40, 10.

By filling the inner bladder 40 first, the anchor system 2 establishes stability for the anchor system 2 on the surface. Thereafter, when the outer bladder 10 fills second, the anchor system 2 is already stable on the angled surface and is more likely to stay in place as the weight of the water fills the outer bladder 10 throughout the anchor system 2 and overlapping the inner bladder 40 and the bridle 22. In some embodiments, by placing a majority of the internal volume 42 of the inner bladder 40 closer to the uphill end 4 of the anchor system 2 than to the downhill end 6, the weight of the water at the uphill end 4 tends to better hold the anchor system 2 in place as the weight of the water in the outer bladder 10 moves downhill to the downhill end 6 of the anchor system 2. As illustrated in FIG. 7, the bladder anchor system 80 comprises a plurality of bladder anchors 2 configured as described in relation to FIGS. 1-6, and further includes a pump 82 with a pump fill hose 84 and a pump source hose 86 that may be used to draw water from the body of water in which a boat 34 is floating to pump it into each of the bladder anchors 2.

In particular embodiments, the pump 82 may be incorporated into the boat 34 and even built into the structure of the boat 34 as part of an anchor system. Although any size and volume of pump 82 may be used, larger flow volume pumps are desirable to fill the bladder(s) more quickly in use. In a particular embodiment, a pump 82 having a flow rate of between 150-300 gallons/minute is incorporated into a boat 34 with a fill hose 84 connection on an external surface of the boat 34 to which the pump fill hose 84 is connected for filling a bladder anchor system. By incorporating the pump 82 directly into the structure of the boat 34 during manufacturing, additional storage space is not required for the pump 82 and the user can conveniently draw water through a pump source hose 86 or other port on a surface of the bottom of the boat 34 directly from the body of water on which the boat 34 floats without the hassle of moving a heavy pump 82 into position from its storage location on the boat 34. The boat 34 may be any type or model of boat, but it is specifically contemplated that a large houseboat or a large yacht is most beneficial to have the pump 82 mounted to the boat or built into the structure of the boat 34 or provided with a position on the boat 34 where it can be used directly from the boat 34.

An ideal positioning of the bladder anchor system 2 may involve creating an approximate 25-90 degree angle between the anchor lines 36 and the boat 34 on each side, as depicted in FIG. 7. Narrower positioning may potentially allow for some degree of movement of the boat from side to side. However, other anchoring implements, such as an anchor pin or a weighted anchor off the bow of the boat, may help prevent side to side movement.

The inner bladder and outer bladder drain tubes 44, 18, may be folded up over the top of the outer bladder shell 12 and secured with a drain tube clamp 70. In the particular embodiment illustrated in FIGS. 4-6, the drain tube clamp 70 is mounted on the top wall 54 of the outer bladder shell 12. Alternatively, it may be mounted elsewhere, or maintained separate from the outer bladder 10. Placement of the drain tube clamp 70 on top of the outer bladder shell 12 adjacent the uphill end 4 of the anchor system 2 was found to be a convenient location for use and reduction of forces on the drain system when not in use. The drain tube clamp 70 may be configured to clamp both the inner bladder drain tube 44 and the outer bladder drain tube 18 simultaneously with a single clamp by folding the combined drain tubes 18, 44 through the clamp. The drain tubes 18, 44 may then be folded back toward the downhill end 6 of the anchor system 2 for convenience of storage. In particular embodiments, additional drains 74 may be included through the outer bladder shell 12 at select locations, such as adjacent the corners of the outer bladder shell 12, with removable drain caps 76 to selectively allow a user to increase the drain rate of water from within the outer bladder 10.

The bladder anchor 2 is not limited to just two bladders. In particular implementations, the outer bladder 10 and inner bladder 40 may be just two of the at least two bladders used for the system. Furthermore, inclusion of the inner bladder 40 within the outer bladder 10 or even within the footprint of the outer bladder is not a requirement. In particular embodiments, the inner bladder 40 may be beneath the outer bladder 10, between the outer bladder 10 and the bridle 22, either fully overlapped by the outer bladder 10 or only partially overlapped by the outer bladder 10. In other particular embodiments, the inner bladder 40 may be positioned near the uphill end 4 of the anchor system 2 and the outer bladder 10 may be positioned near the downhill end 6 of the anchor system 2 so that they sit side-by-side. Additional bladders may also be included as part of the bladder anchor 2 so that there are multiple bladders serving the functions described for the inner bladders or multiple bladders serving the functions described for the outer bladders or multiple inner bladders. The relative sizes or volumes for the outer bladder 10 and inner bladder 40 are not critical, and may include bladders of the same volume, or different volumes. Various volume sizes may be better or worse for particular uses and will vary at least based upon the size of the boat that needs to be held and the particular application for the bladder anchor systems 2. Nevertheless, those of ordinary skill in the art will appreciate that bladders may be any shape or size that is operable to securely apply weight upon a bridle upon which the bladder rests, so as to anchor the bridle to a shoreline upon which it is located.

As can be seen from the examples and explanation provided herein, an anchor system 2 may, in a simple embodiment, include a bridle 22 with a bridle harness 26 and attachment points 30 configured to couple to an anchor line 36 of a boat. A bladder anchor 2 may be coupled to the bridle harness 26 and include at least two inner compartments 10, 40 configured to receive water therein. A first of the at least two inner compartments 40 includes a portion of its volume closer to an uphill end 4 of the anchor system 80 and a second of the at least two inner compartments 10 includes a portion of its volume closer to a downhill end 6 of the anchor system 80. A water inlet 14 is configured to receive water from outside the bladder anchor 2 directly into the first of the at least two compartments 40. The water from the first compartment 40 overflows into the second compartment 10 to fill the second compartment.

The concepts disclosed herein are not limited to the specific bladder anchor system implementations shown herein. For example, it is specifically contemplated that the components included in particular bladder anchor implementations may be formed of any of many different types of materials or combinations that can readily be formed into shaped objects and that are consistent with the intended operation of the bladder anchor system implementations. For example, the components may be formed of: rubbers (synthetic and/or natural); vinyl and/or other like materials; glasses (such as fiberglass), carbon-fiber, aramid-fiber, any combination thereof, and/or other like materials; woven textiles, polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; wood or wood-like composites and/or other like materials; rope, formed of either or both synthetic and/or natural fibers, metals, such as zinc, magnesium, titanium, copper, iron, steel, carbon steel, alloy steel, tool steel, stainless steel, spring steel, aluminum, any combination thereof, and/or other like materials; alloys, such as aluminum alloy, titanium alloy, magnesium alloy, copper alloy, any combination thereof, and/or other like materials; any other suitable material; and/or any combination of the foregoing.

Furthermore, bladder anchor system implementations may be manufactured separately and then assembled together, or any or all of the components may be manufactured simultaneously and integrally joined with one another. Manufacture of these components separately or simultaneously, as understood by those of ordinary skill in the art, may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a plastic weld, a fastener, any combination thereof, and/or the like for example, depending on, among other considerations, the particular material(s) forming the components.

In places where the description above refers to particular bladder anchor system implementations, it should be readily apparent that a number of modifications may be made without departing from the spirit thereof and that these implementations may be applied to other implementations disclosed or undisclosed. The presently disclosed bladder anchor system implementations are, therefore, to be considered in all respects as illustrative and not restrictive.

The implementations of the bladder anchor system described are by way of example or explanation and not by way of limitation. Rather, any description relating to the foregoing is for the exemplary purposes of this disclosure, and implementations may also be used with similar results for a variety of other applications requiring a non-destructive anchor system using a bladder.

What is claimed is:

1. An anchor system comprising:

a first bladder comprising a first bladder shell defining a first bladder volume therein, the first bladder comprising a first bladder drain in fluid communication with the first bladder volume adjacent a first end of the anchor system, opposite a second end of the anchor system;

a second bladder fixedly coupled to the first bladder shell and comprising a second bladder shell defining a second bladder volume therein, the second bladder comprising a second bladder drain in fluid communication with the second bladder volume adjacent the first end of the anchor system; and at least one water inlet comprising a water inlet coupling configured to couple to a fill hose to receive water from outside the first bladder directly into the second bladder volume; and an air vent, separate from the at least one water inlet, configured to regulate air out of the first bladder during filling of the anchor system;

wherein a portion of the second bladder volume is closer to the second end of the anchor system than to the first end, and a portion of the first bladder volume is closer to the first end of the anchor system than to the second end; and wherein the anchor system is configured to couple with a watercraft and secure the watercraft in a desired location on a body of water;

wherein the first bladder drain is a bladder drain tube extending from the first bladder adjacent the first end of the anchor system, the anchor system further comprising a drain tube clamp adjacent the second end of the anchor system configured to clamp the bladder drain tube.

2. The anchor system of claim 1, further comprising a first plurality of bladder reinforcement connectors coupled to a top wall of the first bladder and extending from a top wall of the first bladder toward a bottom wall of the first bladder.

3. The anchor system of claim 1, wherein the second bladder shell is contained within the first bladder shell.

4. The anchor system of claim 1, wherein the second bladder shell is immediately adjacent the first bladder shell.

5. The anchor system of claim 1, further comprising a bridle having a bridle substrate fixedly coupled to a bridle harness and having at least one attachment point configured to couple to an anchor line, the first bladder and the second bladder each coupled to the bridle harness.

6. The anchor system of claim 5, wherein the bridle harness further comprising at least two harness straps respectively extending from adjacent a bottom wall of the first bladder over a top wall of the first bladder on least two corners of the first bladder.

7. The anchor system of claim 1, further comprising at least two additional drains each respectively positioned adjacent a first corner and a second corner of the first bladder shell and configured to selectively release water from the anchor system, each of the at least two additional drains comprising removable drain caps.

8. The bladder system of claim 1, further comprising a substrate coupled to the anchor system and extending between the first end of the anchor system and the second end of the anchor system.

9. An anchor system comprising:

a bridle comprising a bridle substrate and a bridle harness fixedly attached to the bridle substrate and comprising attachment points each configured to couple to an anchor line;

at least one bladder coupled to the bridle harness, the at least one bladder comprising a bladder shell defining a bladder volume therein, the at least one bladder comprising a bladder drain in fluid communication with the bladder volume adjacent a first end of the anchor system, opposite a second end of the anchor system;

a water inlet, separate from the bladder drain and configured to receive water from outside the at least one bladder into the bladder volume through a water inlet coupling configured to couple to a fill hose, such that water introduced through the water inlet contacts the bladder volume before it passes through the bladder volume to contact the at least one bladder drain;

at least two additional drains each respectively positioned adjacent a first corner and a second corner of the first bladder shell and configured to selectively release water from the anchor system, each of the at least two additional drains comprising removable drain caps; and an air vent, separate from the water inlet and the bladder drain, the air vent configured to release air out of the at least one bladder as water is received through the water inlet;

wherein the anchor system is configured to couple with a watercraft and secure the watercraft in a desired location on a body of water.

10. The anchor system of claim 9, further comprising a plurality of bladder reinforcement connectors coupled to a top wall of the at least one bladder and extending from the top wall of the at least one bladder toward a bottom wall of the at least one bladder.

11. The anchor system of claim 9, further comprising a first plurality of bladder reinforcement connector points on a bottom wall of the at least one bladder and a second plurality of bladder reinforcement connector points on a top wall of the at least one bladder, wherein a plurality of bladder reinforcement connectors extends between the first plurality of bladder reinforcement connector points and the second plurality of bladder reinforcement connector points.

12. The anchor system of claim 9, wherein the at least one bladder comprises at least a first bladder and second bladder, wherein the water inlet is coupled to the first bladder and is configured to receive water from outside the at least one bladder into the first bladder prior to the water passing from the first bladder into to the second bladder such that water introduced through the water inlet contacts the first bladder before it passes through the second bladder and then from the second bladder to the at least one bladder drain.

13. The anchor system of claim 9, wherein the at least one bladder, bridle and water inlet are each at least one first bladder, a first bridle, and first water inlet forming a first anchor, the anchor system further comprising at least a second bladder, a second bridle, and a second water inlet all operatively coupled together like the at least one first bladder, the first bridle, and the first water inlet, but forming a second anchor, wherein the anchor system further comprising at least one anchor line coupled to each of the first anchor and the second anchor.

14. The anchor system of claim 13, wherein the first anchor and the second anchor are configured to couple to a boat to anchor the boat to a shore through the first anchor and the second anchor.

15. The bladder system of claim 9, the bridle harness further comprising at least two harness straps respectively extending from adjacent a bottom wall of the first bladder over a top wall of the first bladder on least two corners of the first bladder.

16. A bladder system comprising:

a first bladder comprising a first bladder shell defining a first bladder volume therein, the first bladder comprising a first bladder drain in fluid communication with the first bladder volume adjacent a first end of the bladder system, opposite a second end of the bladder system;

a second bladder fixedly attached to the first bladder shell and comprising a second bladder shell defining a second bladder volume therein, the second bladder comprising a second bladder drain in fluid communication with the second bladder volume adjacent the first end of the bladder system;

at least one water inlet configured to receive water from outside the first bladder directly into the second bladder volume;

at least two additional drains each respectively positioned adjacent a first corner and a second corner of the first bladder shell and configured to selectively release water from the bladder system, each of the at least two additional drains comprising removable drain caps; and an air vent, separate from the at least one water inlet, the air vent configured to release air out of the bladder system as water is received through the at least one water inlet;

wherein a majority of the second bladder volume is closer to the second end of the bladder system than to the first end, and a majority of the first bladder volume is closer to the first end of the bladder system than to the second end.

17. The bladder system of claim 16, further comprising a first plurality of bladder reinforcement connectors coupled to a top wall of the first bladder and extending from a top wall of the first bladder toward a bottom wall of the first bladder.

18. The bladder system of claim 16, wherein the second bladder shell is contained within the first bladder shell.

19. The bladder system of claim 16, wherein the first bladder drain is a bladder drain tube extending from the first bladder adjacent the first end of the bladder system, the bladder system further comprising a drain tube clamp adjacent the second end of the bladder system configured to clamp the bladder drain tube.

20. The bladder system of claim 16, further comprising a substrate coupled to the bladder system and extending between the first end of the bladder system and the second end of the bladder system.

* * * * *